US007900287B2

(12) United States Patent
Wildauer et al.

(10) Patent No.: US 7,900,287 B2
(45) Date of Patent: Mar. 8, 2011

(54) RELEASABLE HANDLE MECHANISM FOR A DISPOSABLE TOILET IMPLEMENT

(75) Inventors: John B. Wildauer, Cherry Hill, NJ (US); Chris Agami, Coconut Creek, FL (US); Paul Metaxatos, Swampscott, MA (US)

(73) Assignee: Cobra Products, Inc., Bridgeport, NJ (US)

( * ) Notice: Subject to any disclaimer, the term of this patent is extended or adjusted under 35 U.S.C. 154(b) by 1291 days.

(21) Appl. No.: 11/454,284

(22) Filed: Jun. 16, 2006

(65) Prior Publication Data

US 2007/0089224 A1 Apr. 26, 2007

Related U.S. Application Data

(60) Provisional application No. 60/728,970, filed on Oct. 21, 2005.

(51) Int. Cl.
*E03D 11/00* (2006.01)

(52) U.S. Cl. ..... 4/255.11

(58) Field of Classification Search ..... 4/255.11; 15/145, 176.6, 210.1; 16/422; 81/164, 489; 294/19.1

See application file for complete search history.

(56) References Cited

U.S. PATENT DOCUMENTS 186,609 A * 1/1877 Palmer ..... 294/19.1 X
1,064,888 A * 6/1913 Daly ..... 16/422 X
1,684,880 A 9/1928 Norton
1,852,071 A 4/1932 Becker
2,320,967 A 6/1943 Dunkelberger
2,610,347 A 9/1952 Kleiner
2,648,085 A 8/1953 Rodgers
2,666,224 A 1/1954 Adams
2,668,974 A 2/1954 Jaeger
4,031,673 A 6/1977 Hagelberg
4,186,451 A 2/1980 Ruo
4,457,038 A 7/1984 Hammond
4,575,143 A 3/1986 Nast
4,987,634 A 1/1991 Weihrauch
5,323,507 A 6/1994 Tosato
5,335,374 A 8/1994 Wilk et al.
5,865,077 A * 2/1999 Moffitt et al. ..... 81/489 X
6,094,771 A 8/2000 Egolf et al.
6,463,620 B2 10/2002 Busha
6,611,986 B1 9/2003 Seals
6,701,540 B1 3/2004 Gabriel
6,709,185 B2 * 3/2004 Lefevre ..... 15/176.6 X
6,745,427 B1 6/2004 Trenz et al.
2004/0010877 A1 1/2004 Jackson
2004/0129296 A1 7/2004 Treacy et al.
2004/0255418 A1 12/2004 Minkler et al.
2005/0056558 A1 3/2005 Belser et al.
2005/0066465 A1 3/2005 Minkler et al.
2005/0132538 A1 6/2005 Thomeczek et al.

* cited by examiner

*Primary Examiner* — Lori Baker
(74) *Attorney, Agent, or Firm* — Carlson Gaskey & Olds P.C.

(57) ABSTRACT

A toilet tool generally includes a handle assembly and one or more disposable toilet tool implements such as a cleaning pad and a plunger cup. The handle assembly receives either the cleaning pad or the plunger cup with sufficient engagement to prevent inadvertent release during use yet is easily released in a hands-free manner for disposal.

20 Claims, 14 Drawing Sheets

RELEASABLE HANDLE MECHANISM FOR A DISPOSABLE TOILET IMPLEMENT

The present application claims priority to U.S. Provisional Patent Application Ser. No. 60/728,970, filed Oct. 21, 2005.

BACKGROUND OF THE INVENTION

The present invention relates to a disposable toilet implement and, in particular, to a handle capable of selectively releasing the disposable toilet implement in a hands-free manner for disposal to avoid biocontamination.

As the consuming public becomes more and more concerned with biocontaminants, the market for disposable toilet implements has grown exponentially. Traditionally, toilet brushes and toilet plungers were utilized for their designed task then rinsed and stored in an appropriate caddy for subsequent re-use as needed.

In order to reduce contamination, devices have recently entered the market which allow for disposal of the cleaning head after use. Many of these devices had limitations because the connection between the scrubbing pad and the handle did not allow a substantial amount of torque to be applied to the cleaning pad without inadvertent release.

Furthermore, known disposable toilet implements are typically designed for engagement with only a single implement as the connection is specifically tailored therefor. That is, a cleaning pad must resist a particular force application such as torque while a plunger must resist a longitudinal force typical of a plunging action.

Accordingly, it is desirable to provide a toilet tool which readily receives a toilet tool implement with sufficient engagement to prevent inadvertent release during use yet is thereafter easily released in a hands-free manner for disposal.

SUMMARY OF THE INVENTION

A toilet tool according to the present invention generally includes a handle assembly and one or more disposable toilet tool implements such as a cleaning pad and a plunger cup. The handle assembly receives either the cleaning pad or the plunger cup with sufficient engagement to prevent inadvertent release during use yet is easily released for disposal.

In use, the handle assembly is readily mounted to the toilet tool implement simply by applying downward pressure onto a protruding stud which extends from the disposable toilet tool implement. Flexible tabs are compressed inward by an annular shoulder of the handle assembly until the tabs enter a cavity a distance in which an outwardly formed shoulder is engaged with the annular shoulder. The desired disposable toilet tool implement is thereby snapped into place and may thence be employed. Once finished, the handle assembly is then moved to a waste receptacle for disposal of the implement. To do so, an actuator knob on the handle assembly is rotated and the toilet tool implement is released.

A storage caddy contains one handle assembly, a multiple of cleaning pads and a multiple of plunger cups. The multiple of cleaning pads and the multiple of plunger cups are stored in a stacked arrangement for ready hands-free access with the handle assembly.

The present invention therefore provides a toilet tool which readily receives a toilet tool implement with sufficient engagement to prevent inadvertent release during use yet is thereafter easily released in a hands-free manner for disposal.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
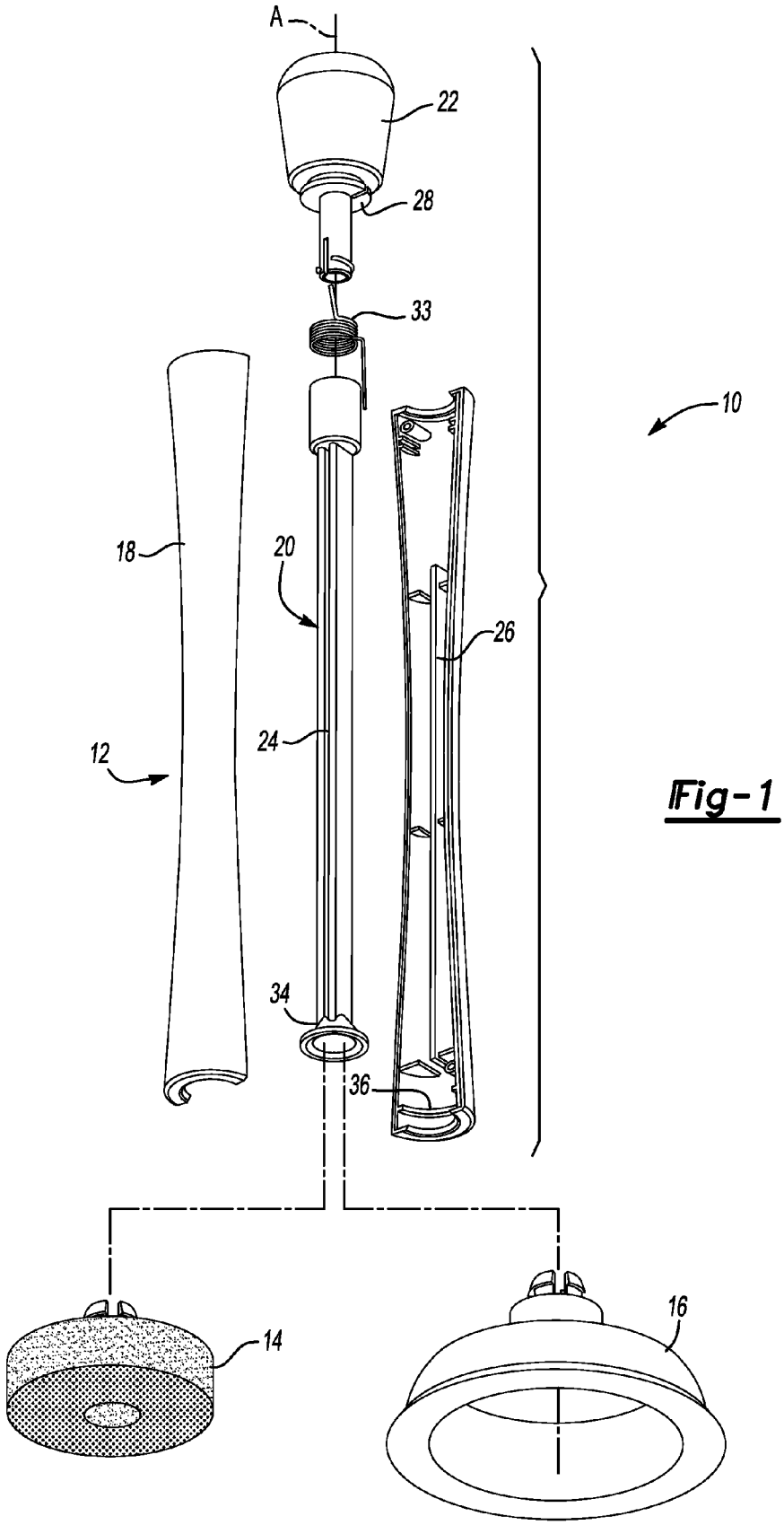
FIG. 1 is an exploded view of a toilet tool according to the present invention.

FIG. 1 illustrates a general exploded view of a toilet tool 10. The toilet tool 10 generally includes a handle assembly 12 and one or more toilet implements such as a cleaning pad 14 and a plunger cup 16. The handle assembly 12 is capable of receiving either the cleaning pad 14 or the plunger cup 16 with sufficient engagement to prevent inadvertent release during use of the implement. It should be understood that any number of implements will be usable with the handle assembly 12 of the present invention.

The handle assembly 12 generally includes an elongated body 18, a slider 20 and an actuator knob 22. The slider 20 is received within the elongated body 18 such that it is slidable along a longitudinal axis A within the elongated body 18 in response to rotation (illustrated by arrow B in FIG. 2) of the actuator knob 22. The slider 20 is preferably relatively square in cross-section with a pair of longitudinal slots 24 (also illustrated in FIG. 3) to define a generally H-shape in cross-section. The slider 20 is received within a complementary support structure 26 formed within the elongated body 18 such that the slider 20 may slide but not rotate therein.

Figure 2:
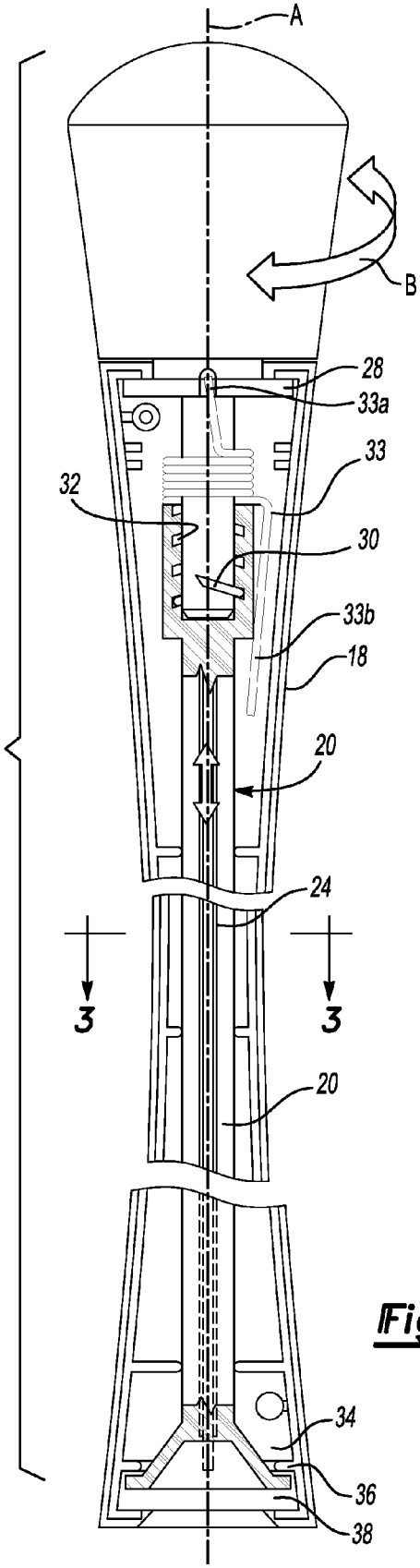
FIG. 2 is a longitudinal sectional view of the handle assembly.
Figure 3:
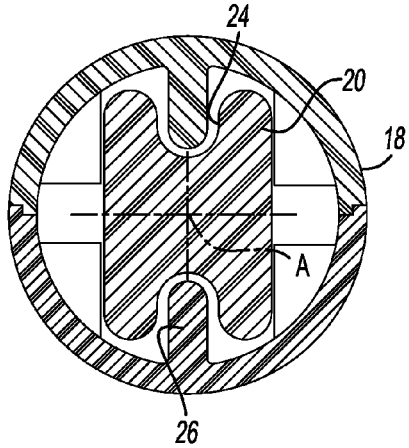
FIG. 3 is a sectional view of the handle assembly taken along line 3-3 in FIG. 2.

The actuator knob 22 includes a radial flange 28 and a threaded section 30. The threaded section 30 engages a complementary female threaded section 32 of the slider 20 (also illustrated in FIG. 2). As seen in FIG. 2, the actuator knob 22 is engaged with the slider 20 by way of the threaded section, and is rotatably engaged with the elongated body 18 by way of, at least, the radial flange 28. The actuator knob 22 may also be rotatably engaged with the elongated body 18 near the adjacent axial end of the elongated body 18. A spring 33 is preferably mounted to the actuator knob 22 to rotationally bias the actuator knob 22. For example, a first end 33*a* of the spring 33 may be in rotational engagement with the radial flange 28, and a second end 33*b* may be mounted to the interior of the elongated body 18 such it is rotationally fixed relative to the radial flange 28. It should be understood, however, that the actuator knob 22 need not be so biased.

Referring to FIG. 2, the slider 20 includes a conical end segment 34 opposite the threaded section 32. The conical end segment 34 is received within the elongated body 18 adjacent a stop 36 formed by the support structure 26. The support structure 26 further defines an annular shoulder 46 formed adjacent an end cavity 38 of the elongated body 18.

The spring 33 rotationally biases the actuator knob 22 to axially bias the slider 20 into the elongated body 18 such that the conical end segment 34 is biased into contact with the stop 36. Rotation of the actuator knob 22 drives the slider 20 along axis A; release of the knob 22 drives the conical end segment 34 into contact with the stop 36 under the bias of the spring 33.

Figure 4A:
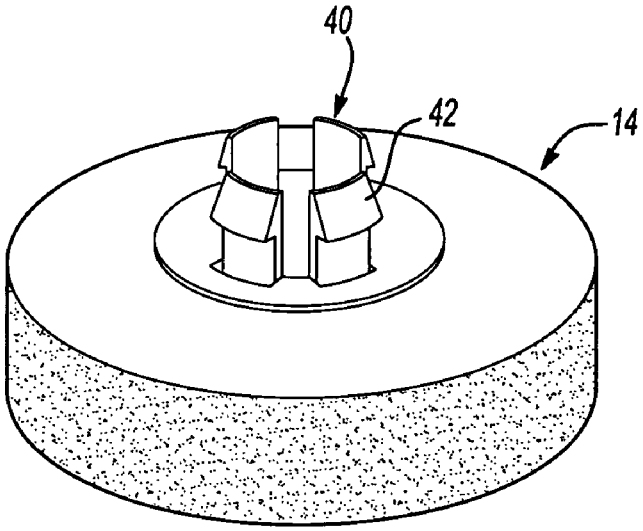
FIG. 4A is a perspective view of a disposable cleaning pad receivable by the handle assembly.
Figure 4B:
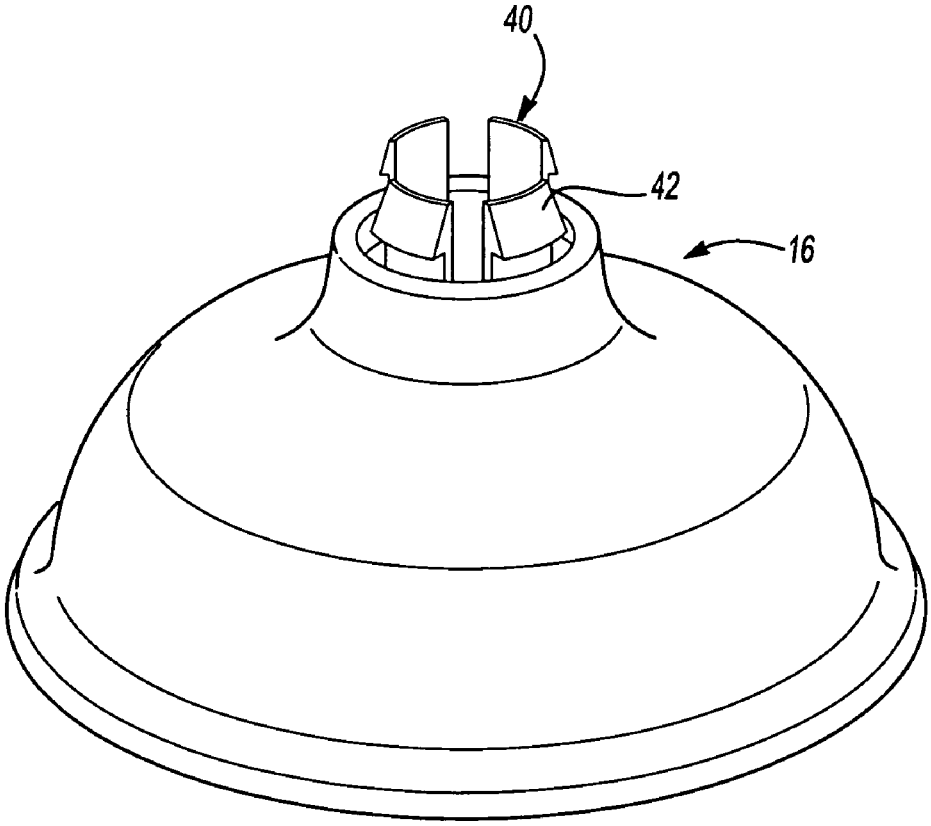
FIG. 4B is a perspective view of a disposable plunger cup receivable by the handle assembly.
Figure 4C:
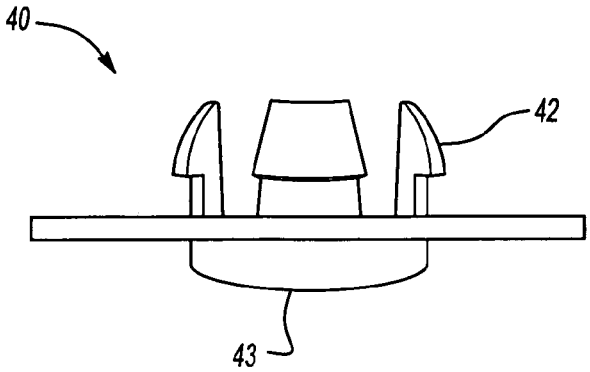
FIG. 4C is a side view of a protruding stud which receives the handle.
Figure 4D:
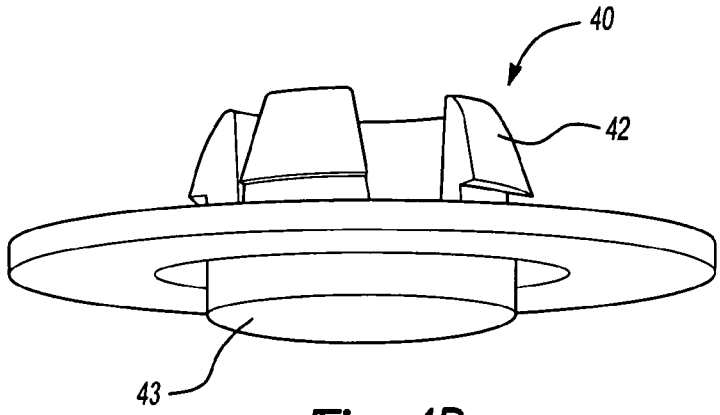
FIG. 4D is a perspective view of the protruding stud which receives the handle.
Figure 4E:
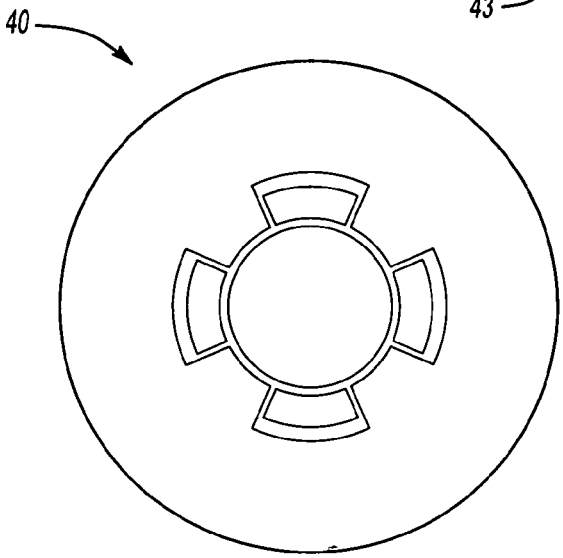
FIG. 4E is a top view of the protruding stud which receives the handle.
Figure 4F:
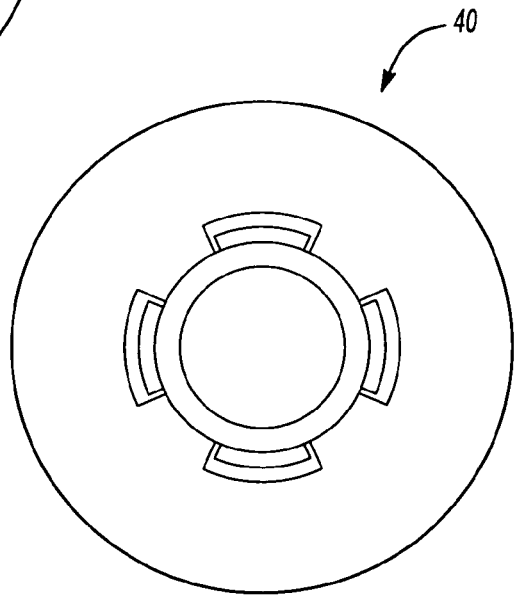
FIG. 4F is a bottom view of the protruding stud which receives the handle.

Referring to FIGS. 4A and 4B, the cleaning pad 14 and the plunger cup 16 include a protruding stud 40. Notably, the protruding stud 40 is identical for both the cleaning pad 14 and the plunger cup 16. The protruding stud 40 preferably includes a multitude of flexible tabs 42. Each of the tabs 42 is generally barb-shaped in cross section (FIG. 5A) to define an outwardly formed shoulder 44 adjacent an angled outer surface 50 to lockingly engage the annular shoulder 46 of the end cavity 38 formed in the elongated body 18 (FIG. 5B). Preferably, the annular shoulder 46 includes an angled surface 48 to receive the angled outer surface 50 of each of the flexible tabs 42 to facilitate receipt thereof. Furthermore, the protruding stud 40 includes a base 43 that distends about ⅛" (best seen in FIGS. 4C-4F) into a die cut hole of the scrubber pad (FIG. 5D) such that when the pads are nested (FIG. 6B), a firm surface to apply the downward force of the handle 12 to engage the scrubbing pad 14.

Figure 5A:
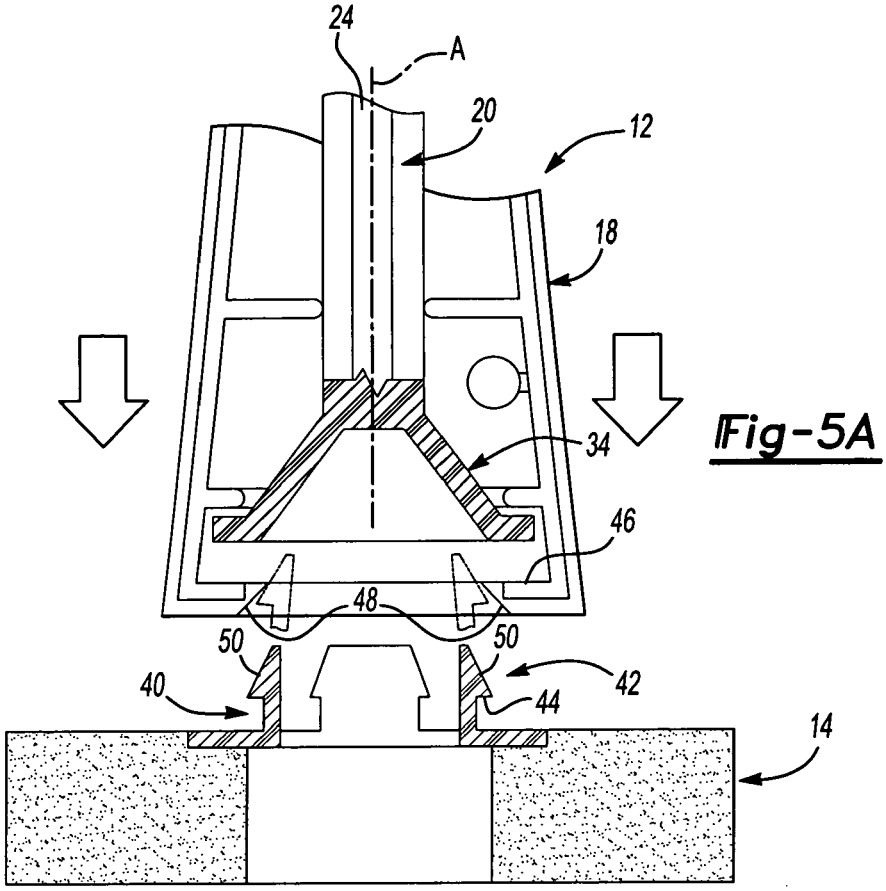
FIG. 5A is a sectional view of the handle assembly prior to attachment to a disposable toilet tool implement.
Figure 5B:
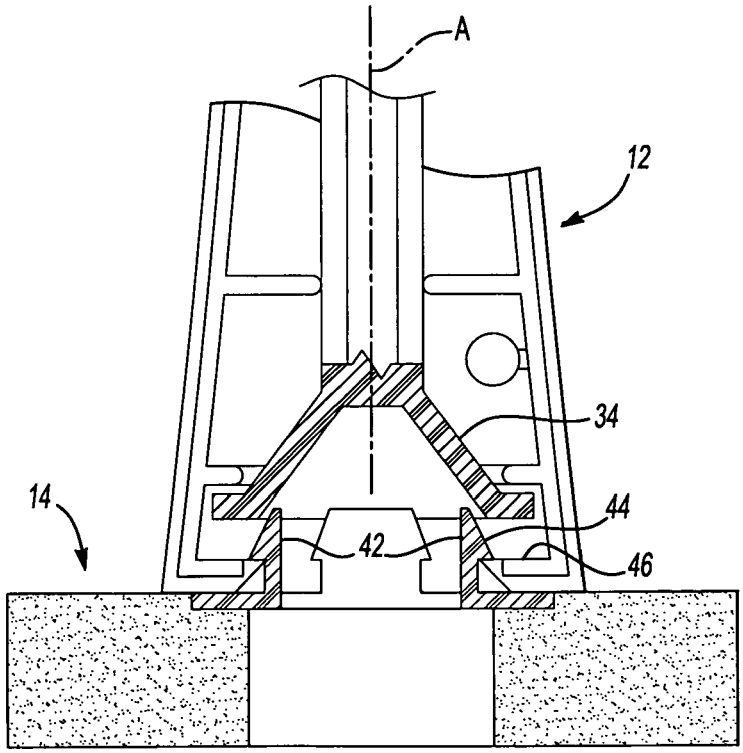
FIG. 5B is a sectional view of a disposable toilet tool mounted to the handle assembly.

Referring to FIG. 5A, the handle assembly 12 is readily mounted to the implement (here illustrated as the pad 14) simply by applying downward pressure. The end cavity 38 is pressed over the protruding stud 40 such that the tabs 42 are compressed inward by the annular shoulder 46 until the tabs 42 enter the cavity 38 a distance in which the outwardly formed shoulder 44 is engaged with the annular shoulder 46 (FIG. 5B). The desired implement is thereby snapped into place and may thence be employed.

Figure 5C:
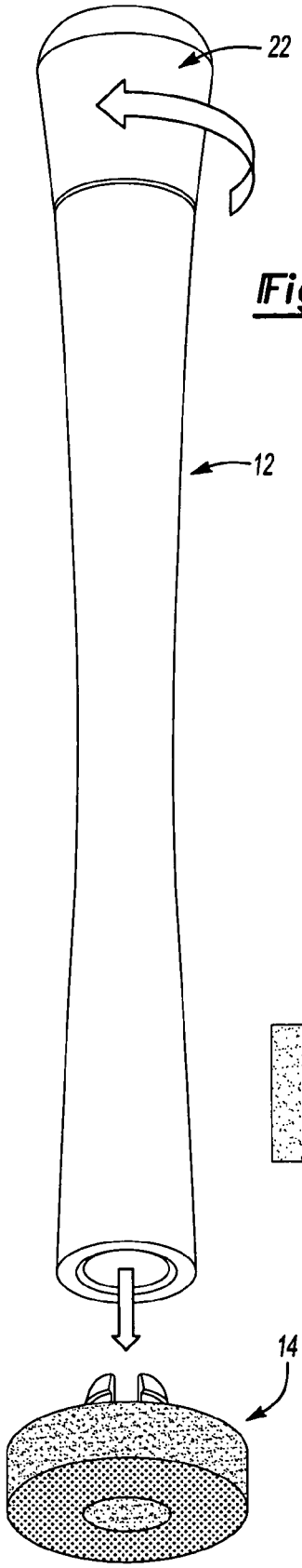
FIG. 5C is a perspective view of the handle assembly ejecting a disposable toilet implement.

Once finished, the handle assembly 12 is then moved to a waste receptacle for disposal of the implement. To do so, the actuator knob 22 is rotated (FIG. 5C) and the implement is released.

Figure 5D:
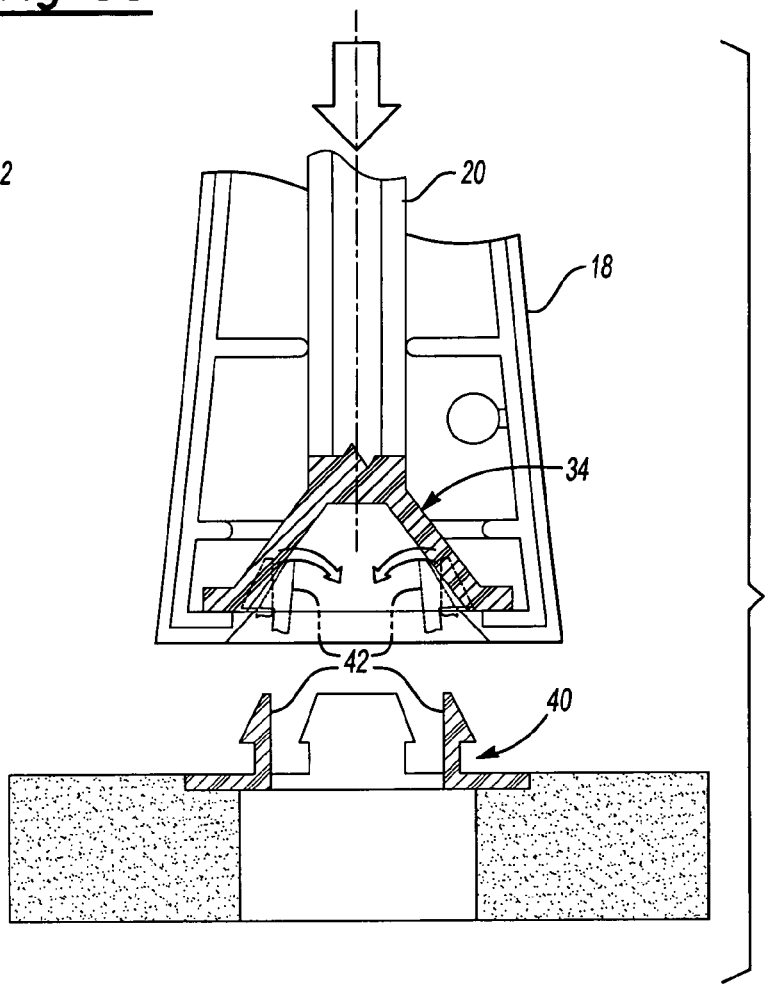
FIG. 5D is a sectional view illustrating the ejection of the disposable toilet implement shown in FIG. 5C.

Referring to FIG. 5D, the actuator knob 22 is rotated (FIG. 5C) to overcome the bias which causes the slider 20 to move axially within the elongated body 18. The conical end segment 34 is driven onto the tabs 42 to compress the tabs 42 inward toward axis A such that the outwardly formed shoulder 44 is disengaged from within the annular shoulder 46 and the disposable toilet tool implement is released. The handle assembly 12 may then be stored for a subsequent use with a replacement implement.

Figure 6A:
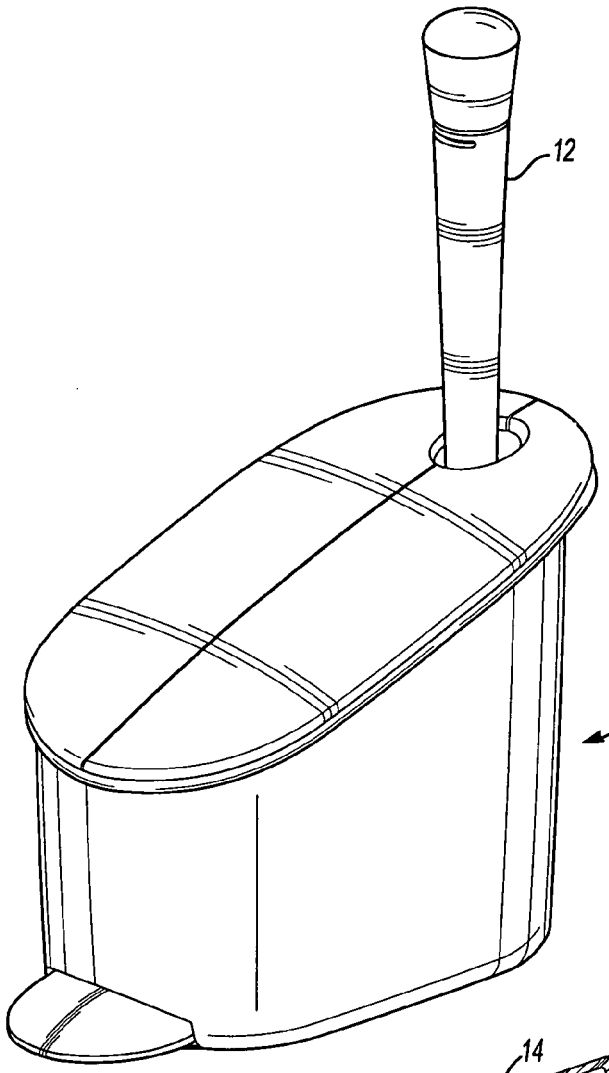
FIG. 6A is a perspective view of a toilet tool caddy.
Figure 6B:
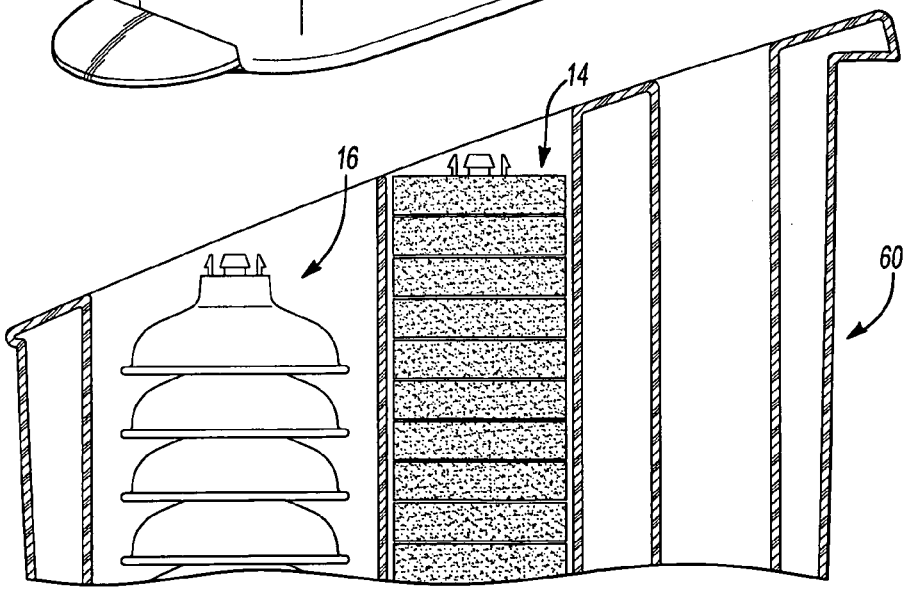
FIG. 6B is a sectional view of the toilet tool caddy showing the stacked arrangement of the disposable toilet implement.
Figure 6C:
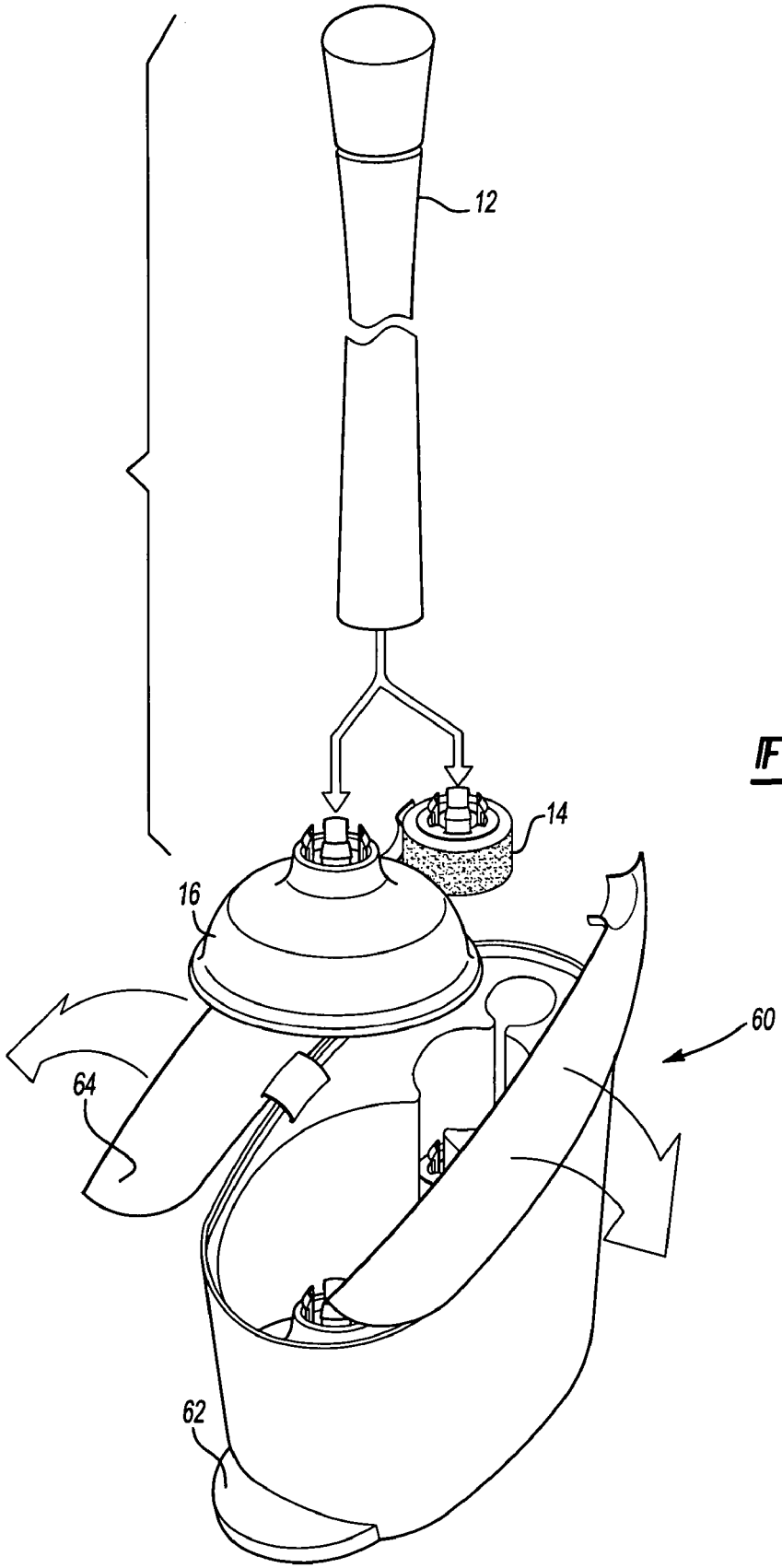
FIG. 6C is a perspective view showing the handle interfacing with either of the disposable toilet tools contained within the caddy.
Figure 6D:
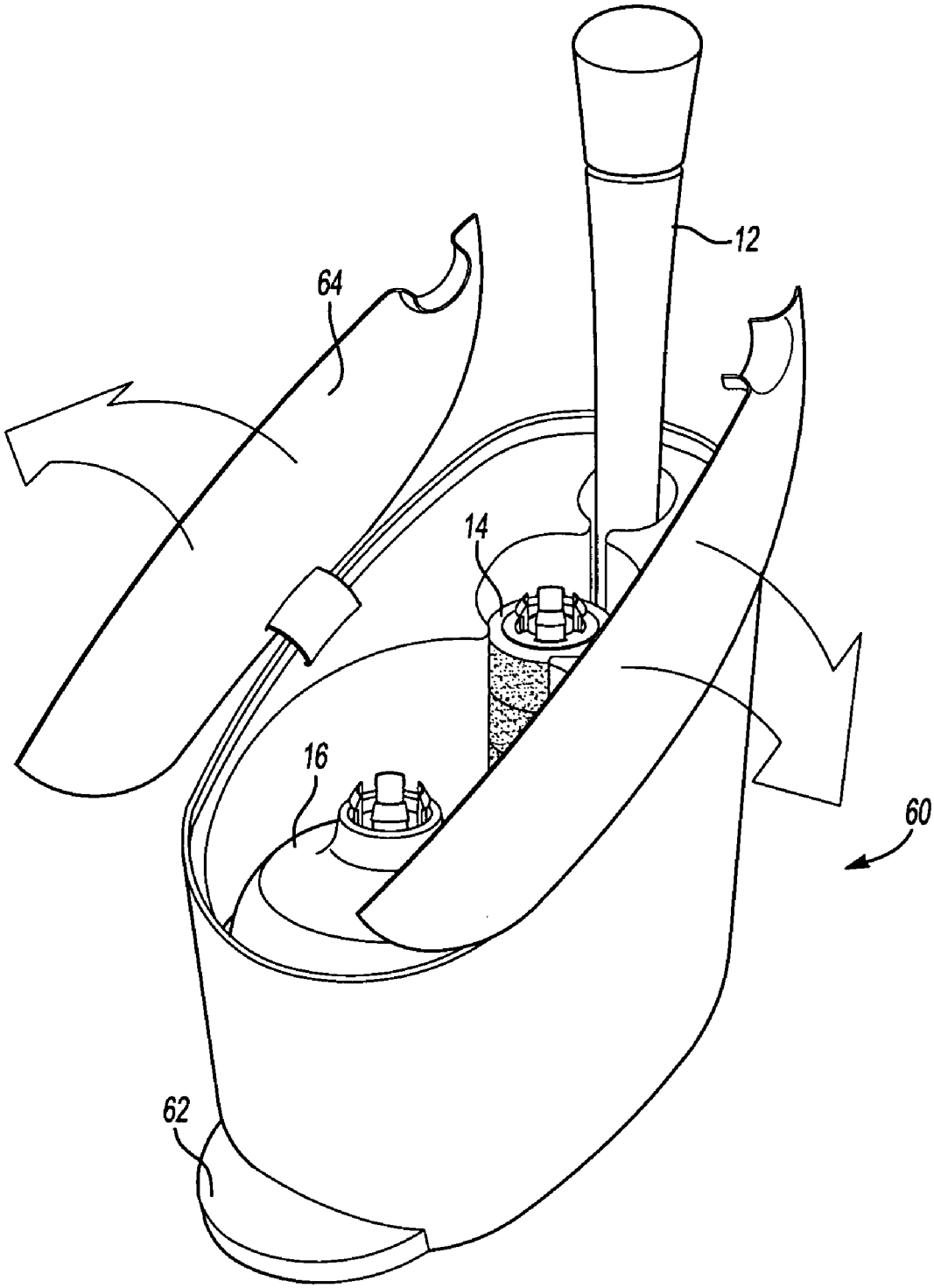
FIG. 6D is a perspective view of the toilet tool caddy with the doors illustrated in an open position in response to a foot pedal.

Referring to FIG. 6A, a storage caddy 60 preferably contains a handle assembly 12, a multiple of cleaning pads 14 and a multiple of plunger cups 16. The multiple of cleaning pads 14 and the multiple of plunger cups 16 are preferably stored in a stacked arrangement (FIG. 6B) for ready access with the handle assembly 12 (FIG. 6C). The storage caddy 60 preferably includes a foot pedal 62 which operates a set of doors 64 to conceal and protect the components therein (FIG. 6D). It should be understood that various known mechanisms may be utilized to operate the doors 64 with the pedal 62.

Figure 7:
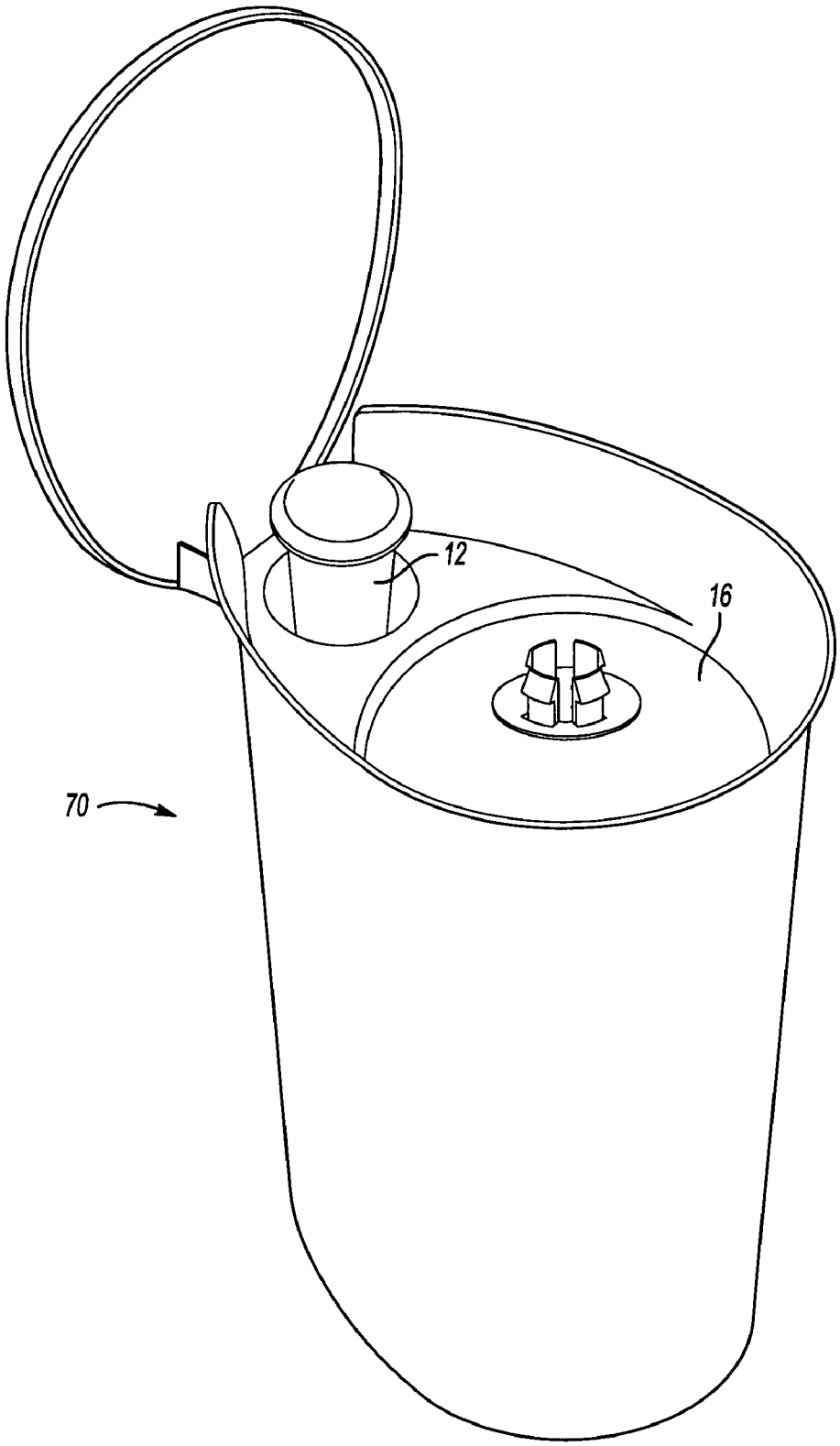
FIG. 7 is a perspective view of another embodiment of the toilet tool caddy.

Referring to FIG. 7, another storage caddy 70 stores only a handle assembly 12 and a multiple of plunger cups 16.

Figure 8:
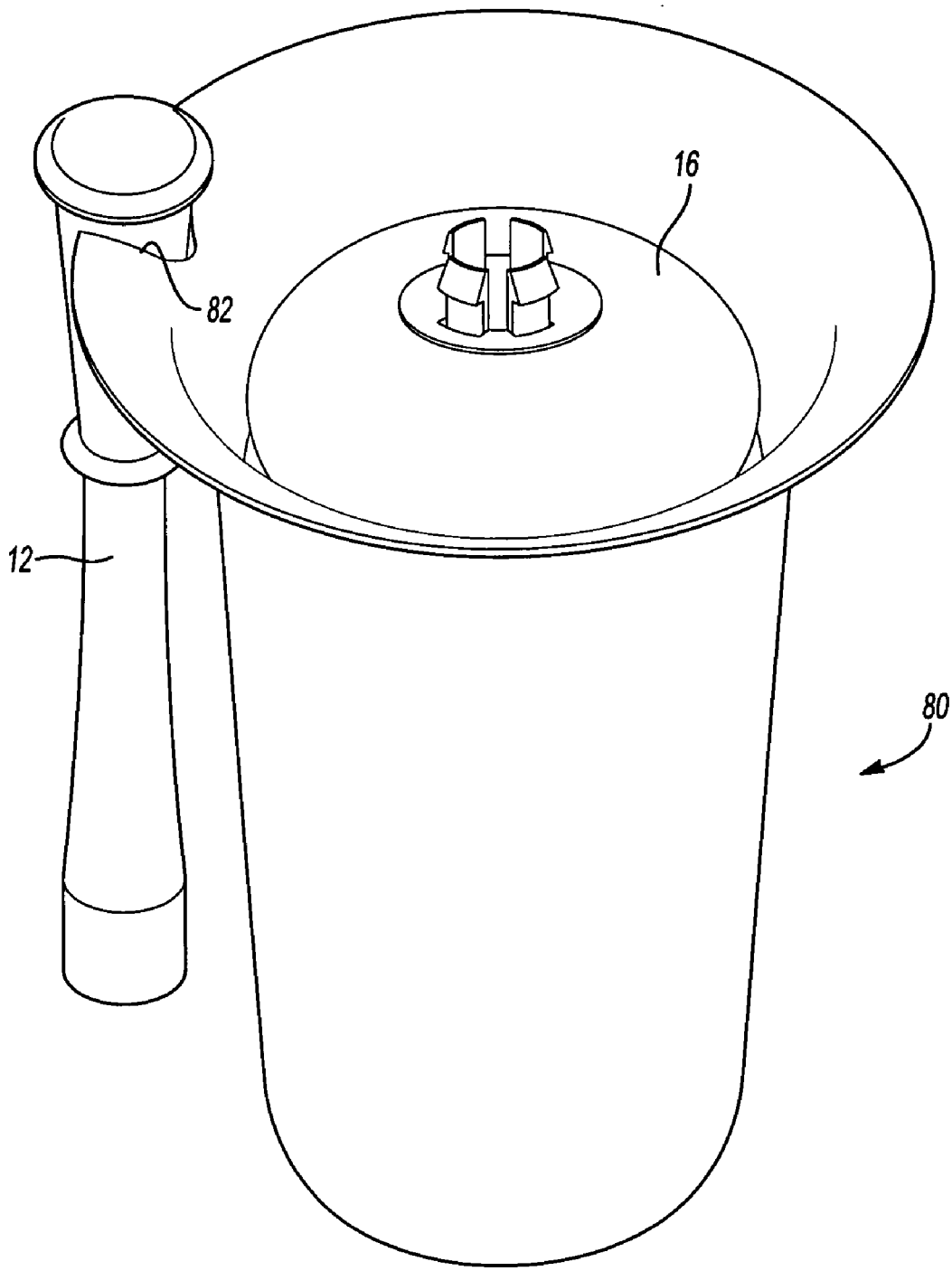
FIG. 8 is a perspective view of another embodiment of the toilet tool caddy.

Referring to FIG. 8, another storage caddy 80 stores only a multiple of plunger cups 16 and hangs the handle assembly 12 in a cutout 82 along an edge thereof.

Figure 9:
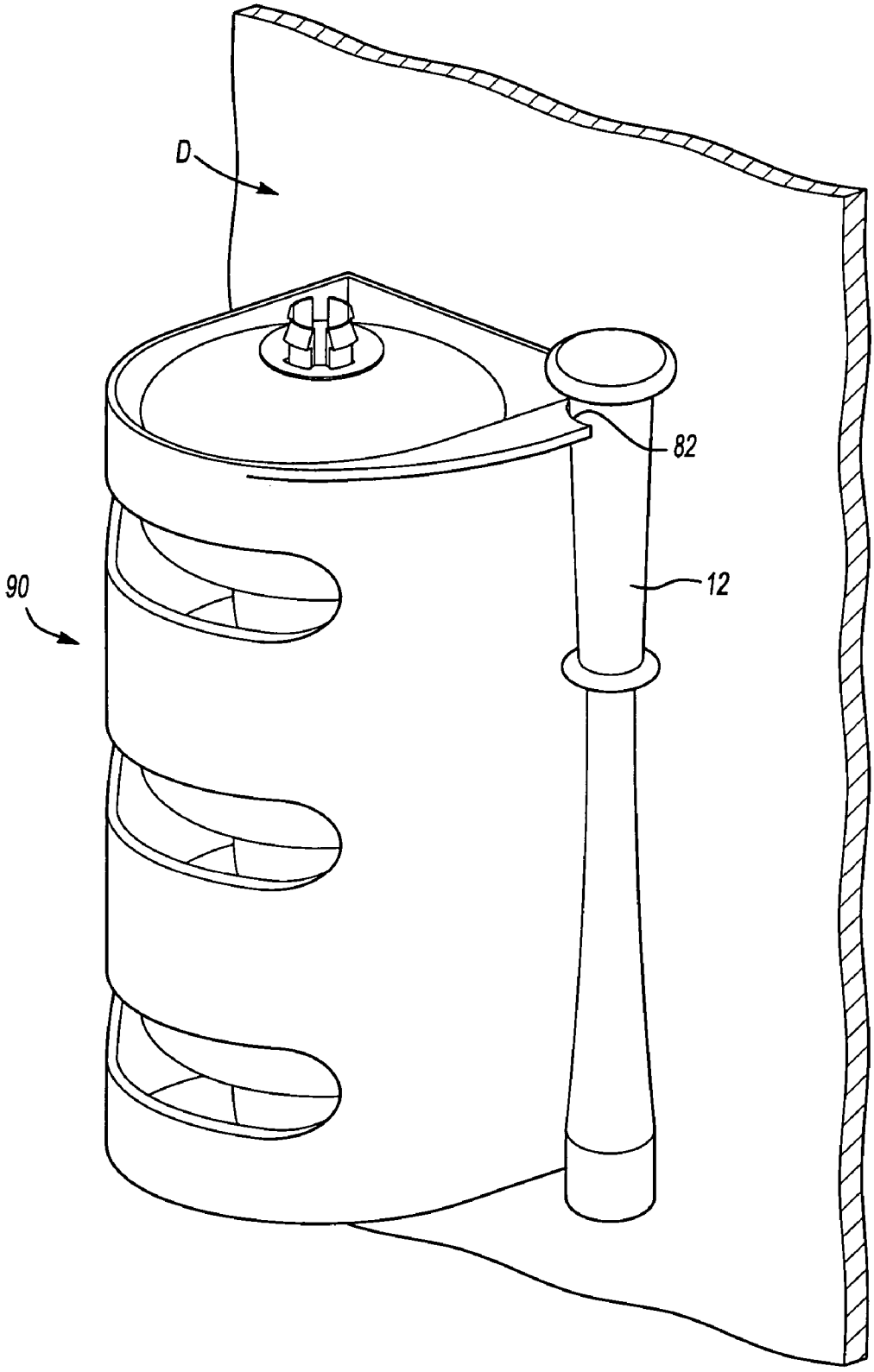
FIG. 9 is a perspective view of another embodiment of the toilet tool caddy.

Referring to FIG. 9, another storage caddy 90 may be mounted along a cabinet interior door D.

Figure 10A:
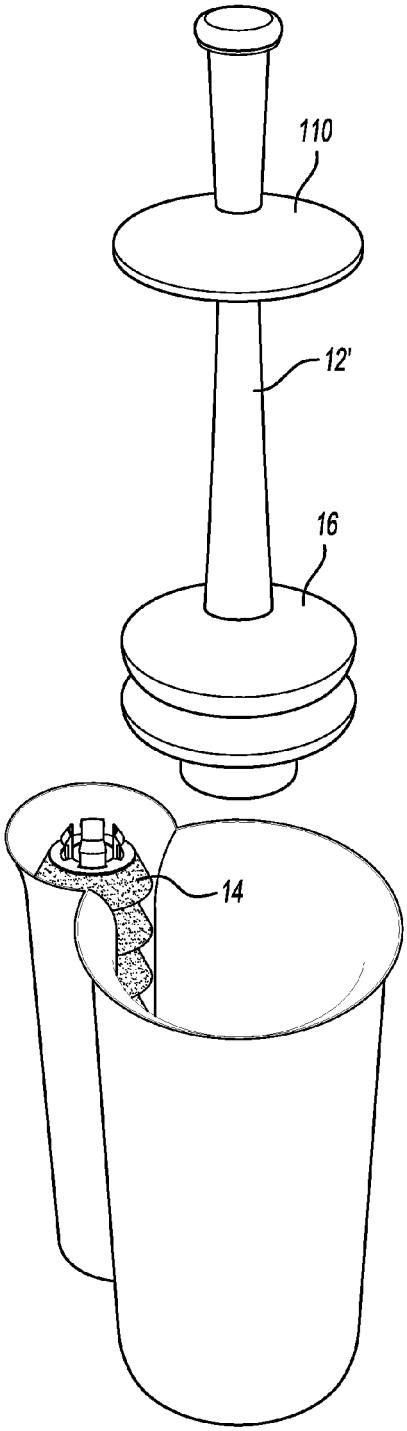
FIG. 10A is an exploded view of a toilet tool caddy.
Figure 10B:
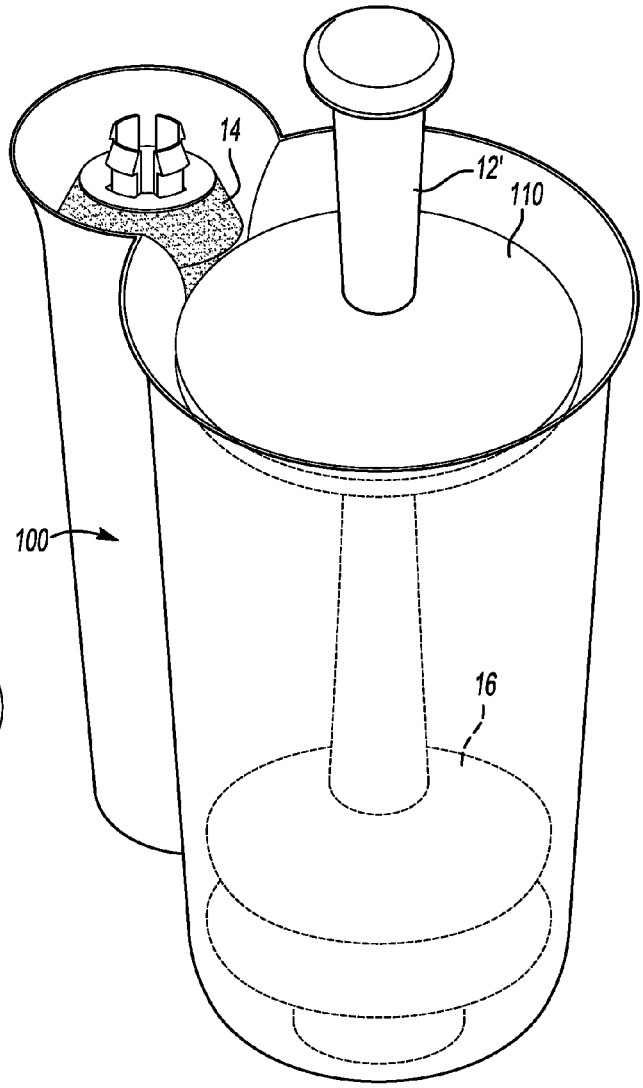
FIG. 10B is a perspective view of the toilet tool caddy of FIG. 10A in a stored position in which the handle assembly conceals some of the disposable toilet implements.

Referring to FIG. 10A, another storage caddy 100 stores a handle assembly 12', a multiple of cleaning pads 14 and a multiple of plunger cups 16 . The handle assembly 12' includes an integral lid 110 which operates to cover the plunger cups 16 when stored in the caddy (FIG. 10B).

Figure 11A:
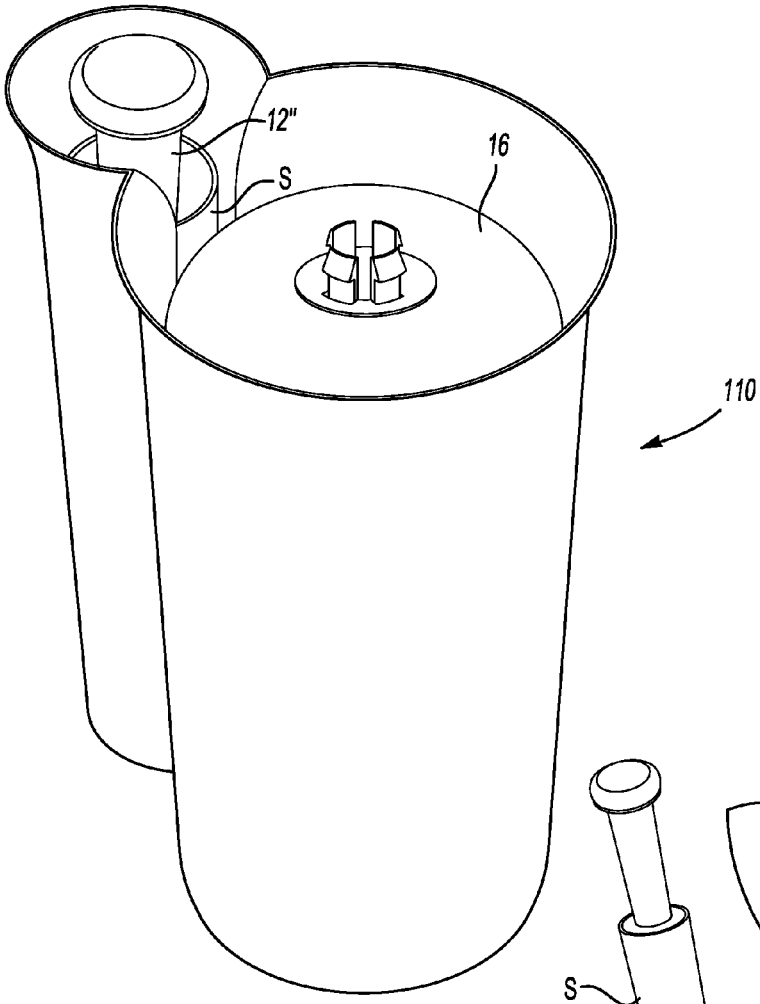
FIG. 11A is a perspective view of yet another toilet tool caddy.
Figure 11B:
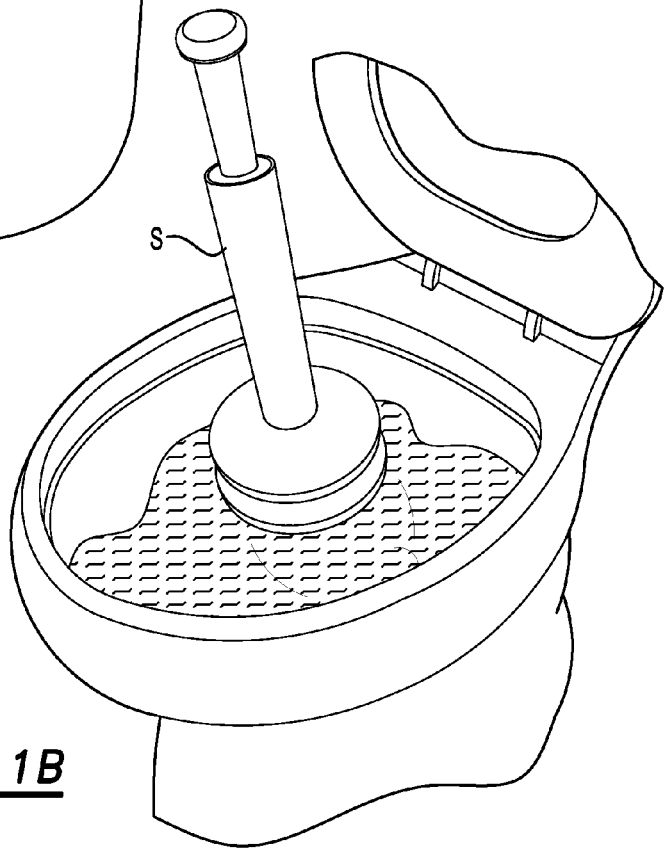
FIG. 11B is a perspective view of the toilet tool shown in FIG. 11A being utilized on a toilet, the toilet tool having a disposable sleeve to protect the handle assembly during usage.

Referring to FIG. 11A, another storage caddy 110 stores a handle assembly 12", a multiple of cleaning pads 14, a multiple of plunger cups 16 and a multiple of disposable protective sleeves S. The sleeves S cover the handle assembly 12" along a length adjacent the implement and may be discarded after (FIG. 11B) use as described above.

It should be understood that relative positional terms such as "forward," "aft," "upper," "lower," "above," "below," and the like are with reference to the normal operational attitude of the vehicle and should not be considered otherwise limiting.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A toilet tool comprising:

an elongated body defined along an axis;

a slider received within said elongated body along said axis;

an actuator knob engaged with said elongated body and said slider, said actuator knob rotatable about said axis to slide said slider along said axis; and a disposable toilet tool implement engageable with an annular shoulder formed within and end cavity of said elongated body.

2. The toilet tool as recited in claim 1, wherein said actuator knob is rotatably mounted to said elongated body and threadably engaged with said slider.

3. The toilet tool as recited in claim 1, wherein said slider is substantially H-shaped in cross-section.

4. The toilet tool as recited in claim 1, wherein said actuator knob is spring biased in a rotational direction to bias said slider toward a stop.

5. The toilet tool as recited in claim 4, wherein said slider is spring biased toward said actuator knob.

6. The toilet tool as recited in claim 1, wherein said slider includes a conical end segment opposite said actuator knob.

7. A toilet tool comprising:

an elongated body defined along an axis;

a slider received within said elongated body along said axis;

an actuator knob engaged with said elongated body and said slider, said actuator knob rotatable about said axis to slide said slider along said axis; and a disposable toilet tool implement having a protruding stud, said protruding stud including a multitude of flexible tabs.

8. The toilet tool as recited in claim 7, wherein each of said multitude of flexible tabs are generally barbed shaped in cross-section.

9. The toilet tool as recited in claim 7, wherein each of said multitude of flexible tabs include an outwardly formed shoulder adjacent an angled outer surface.

10. The toilet tool as recited in claim 1, wherein said slider includes a conical end segment opposite said actuator knob, said conical end segment engageable with a protruding stud of a tool implement to compress a multitude of flexible tabs which form said protruding stud.

11. A toilet tool comprising:

an elongated body defined along an axis;

a slider received within said elongated body along said axis;

an actuator knob engaged with said elongated body and said slider;

a disposable tool implement having a protruding stud, said protruding stud engageable with an annular shoulder formed within an end cavity of said elongated body, said actuator knob rotatable about said axis to slide said slider along said axis and disengage said protruding stud from said annular shoulder.

12. The toilet tool as recited in claim 11, wherein said disposable tool implement includes a cleaning pad.

13. The toilet tool as recited in claim 11, wherein said disposable tool implement includes a plunger.

14. The toilet tool as recited in claim 11, wherein said slider includes a conical end segment opposite said actuator knob, said conical end segment engageable with said protruding stud to compress a multitude of flexible tabs which form said protruding stud.

15. The toilet tool as recited in claim 14, wherein each of said multitude of flexible tabs are generally barbed shaped in cross-section.

16. The toilet tool as recited in claim 14, wherein each of said multitude of flexible tabs include an outwardly formed shoulder adjacent an angled outer surface.

17. A method of attaching and disengaging a disposable toilet tool implement relative to a handle assembly comprising the steps of:

(A) pressing an end cavity of the handle assembly onto a protruding stud of the disposable toilet tool implement to attach the disposable toilet tool implement to the handle assembly;

(B) rotating an actuator knob of the handle assembly about an axis;

(C) sliding a slider within the handle assembly, in response to said step (B), into contact with the protruding stud to disengage the disposable toilet tool implement from the handle assembly.

18. A method as recited in claim 17, further comprising the step of:

(D) stacking a multiple of disposable toilet tool implements within a storage cavity.

19. A method as recited in claim 17, wherein said step (A) includes the steps of:

compressing a multiple of flexible tabs defined by the protruding stud; and engaging an outwardly formed shoulder on each of the flexible tabs with an annular shoulder defined within an end cavity of the handle assembly.

20. A method as recited in claim 19, wherein said step (C) includes the step of:

compressing the flexible tabs toward the axis to disengage the flexible tabs from the annular shoulder to release the disposable tool implement.

* * * * *